US012564270B2

(12) United States Patent
Zhai et al.

(10) Patent No.: US 12,564,270 B2
(45) Date of Patent: Mar. 3, 2026

(54) BUSHING AND BED FRAME

(71) Applicant: JINGNING MEIGE TECHNOLOGY SERVICE CO., LTD., Lishui (CN)

(72) Inventors: Yifan Zhai, Xiangyang (CN); Jiaming Chen, Shengzhou (CN)

(73) Assignee: JINGNING MEIGE TECHNOLOGY SERVICE CO., LTD., Lishui (CN)

( * ) Notice: Subject to any disclaimer, the term of this patent is extended or adjusted under 35 U.S.C. 154(b) by 0 days.

(21) Appl. No.: 18/777,842

(22) Filed: Jul. 19, 2024

(65) Prior Publication Data

US 2026/0007242 A1 Jan. 8, 2026

(30) Foreign Application Priority Data

Jul. 2, 2024 (CN) ..... 202421542400.0

(51) Int. Cl.
*A47C 19/02* (2006.01)

(52) U.S. Cl.
CPC ..... *A47C 19/021* (2013.01)

(58) Field of Classification Search
CPC ..... A47C 19/021; F16B 12/50; B60P 3/36; B60P 3/38; B60P 3/39
USPC ..... 5/279.1
See application file for complete search history.

(56) References Cited

U.S. PATENT DOCUMENTS 1,075,845 A * 10/1913 Mills ..... E04C 3/04 52/843
1,076,918 A * 10/1913 Silver ..... A47C 19/022 5/279.1
1,076,964 A * 10/1913 Dunner ..... A47C 19/022 5/279.1
1,077,944 A * 11/1913 Sloan ..... A47C 19/021 5/206
1,232,961 A * 7/1917 Ohnstrand ..... A47B 17/00 312/351.3
1,328,878 A * 1/1920 Kaplan ..... A47C 19/021 5/300
1,337,340 A * 4/1920 Bradley ..... F16B 12/58 5/294
1,389,918 A * 9/1921 Travis ..... A47C 19/021 74/57
1,414,765 A * 5/1922 Williams ..... A47C 19/04 5/279.1
1,496,580 A * 6/1924 Kusterle ..... A47B 91/00 16/42 T
1,514,836 A * 11/1924 Deadwyler ..... A47C 19/021 5/306
1,538,561 A * 5/1925 Koller ..... F41A 21/10 102/446

(Continued)

*Primary Examiner* — Justin C Mikowski
*Assistant Examiner* — Luke Hall
(74) *Attorney, Agent, or Firm* — HOWARD M COHN and Associates, LLC

(57) ABSTRACT

A bushing for connecting a longitudinal tube and a transverse rod of a bed frame and the bed frame are provided. The bushing includes an inner hole, outer wall surfaces, and bushing opening edges. The inner hole is configured to cover an end portion of the transverse rod. The outer wall surfaces are configured to accommodate in a slot of the longitudinal tube. The bushing opening edges are configured to abut against an outer wall of a first slot opening of the slot of the longitudinal tube facing the transverse rod for enabling the transverse rod to perpendicularly fixed at a transverse direction of longitudinal tube.

10 Claims, 5 Drawing Sheets

(56) References Cited

U.S. PATENT DOCUMENTS 1,730,442 A * 10/1929 Wittliff ..... A47C 19/021 5/306
1,734,616 A * 11/1929 De Boer ..... A47C 19/021 5/306
1,760,100 A * 5/1930 Wittliff ..... A47C 19/021 5/306
2,076,811 A * 4/1937 Ehlers ..... A47C 19/021 5/200.1
2,292,465 A * 8/1942 Neunherz ..... A47C 19/021 5/207
2,492,070 A * 12/1949 Stone ..... A47C 19/025 5/238
2,618,000 A * 11/1952 Harris ..... A47C 19/025 5/286
2,648,073 A * 8/1953 Nowell ..... A47C 19/024 280/35
2,851,702 A * 9/1958 Imber ..... A47C 19/024 5/285
2,911,656 A * 11/1959 Roche ..... A47C 19/024 5/310
2,978,711 A * 4/1961 Hyman ..... A47C 19/04 5/177
3,497,881 A * 3/1970 Price ..... A47C 19/021 5/310
3,680,156 A * 8/1972 McKee ..... A47C 21/006 5/108
4,016,612 A * 4/1977 Barile, Sr. ..... A61G 7/00 403/402
4,070,718 A * 1/1978 Spitz ..... A47C 19/021 5/200.1
4,169,294 A * 10/1979 Harris ..... A47C 19/021 5/200.1
4,586,205 A * 5/1986 Stevens ..... A47C 17/225 5/12.2
4,597,118 A * 7/1986 Mis ..... A47C 23/043 5/264.1
4,700,414 A * 10/1987 Robinson ..... A47C 17/225 5/12.2
6,862,758 B1 * 3/2005 Lai ..... A47C 19/022 403/381
6,925,665 B1 * 8/2005 Hennings ..... A47C 19/021 5/8
8,935,819 B1 * 1/2015 Hartley ..... A47C 23/061 5/236.1
9,080,304 B1 * 7/2015 Roberts ..... A47C 19/005
9,629,472 B1 * 4/2017 Bradley ..... A47C 19/005
11,672,354 B1 * 6/2023 Chen ..... F16B 12/58 5/296
2003/0024045 A1 * 2/2003 Bellows ..... A47C 19/021 5/200.1
2006/0191071 A1 * 8/2006 Polevoy ..... A47C 19/005 5/201
2006/0213008 A1 * 9/2006 Polevoy ..... A47C 19/025 5/310
2010/0154118 A1 * 6/2010 Pearce ..... A47C 19/005 53/474
2014/0245534 A1 * 9/2014 Anderson ..... A47C 19/20 5/9.1
2015/0208811 A1 * 7/2015 Polevoy ..... A47C 19/025 5/200.1
2016/0236027 A1 * 8/2016 Bastyr ..... A63B 23/03525
2017/0065091 A1 * 3/2017 Rodgers ..... A47C 19/021
2019/0000236 A1 * 1/2019 Polevoy ..... A47C 19/02
2019/0099006 A1 * 4/2019 Gerig ..... A47C 23/06
2020/0011359 A1 * 1/2020 Sumner ..... F16B 12/56
2020/0375367 A1 * 12/2020 Qiu ..... A47C 19/005
2022/0213913 A1 * 7/2022 Choi ..... A47C 19/021
2024/0074590 A1 * 3/2024 Werner ..... A47C 19/025
2024/0298807 A1 * 9/2024 Zheng ..... A47C 19/021

* cited by examiner

BUSHING AND BED FRAME

TECHNICAL FIELD

The present disclosure relates to a technical field of furniture, and in particular to a bed frame having a fixed frame and parts of the bed frame.

BACKGROUND

A current bed frame is generally provided with a plurality of transverse rods at intervals between two longitudinal tubes thereof, the plurality of the transverse rods and the two longitudinal tubes cooperate to support the bed frame. In the prior art, a plurality of slots are respectively defined on a side wall and a top wall of each of the two longitudinal tubes for ends of the plurality of the transverse rods to respectively insert into, thereby achieving connection between each of the plurality of the transverse rods and the two longitudinal tubes and avoiding the plurality of the transverse rods from loosening from the two longitudinal tubes. Since there is no limitation between each of the plurality of the transverse rods and corresponding slots, one end of each of the plurality of the transverse rods is easily separated from a corresponding one of the two longitudinal tubes. To this end, Chinese patent having an issue number of CN206102172 discloses a novel bed frame transverse rod connecting structure and a bed frame, in which clamping blocks are respectively disposed on transverse rods for respectively positioning and connecting with the insertion holes defined on longitudinal tubes, the transverse rods are in direct contact with the longitudinal tubes, and the transverse rods and the longitudinal tubes are all metal parts, so that when connecting the transverse rods and the longitudinal tubes, a frictional sound is caused, moreover, such rigid surface contact is more damage to the transverse rods and the longitudinal tubes.

SUMMARY

Based on above, the present disclosure provides a bushing for connecting a longitudinal tube and a transverse rod of a bed frame and the bed frame, aiming to solving a problem in the prior art that the transverse rod is in direct contact with the longitudinal tube, easily causing damage between the transverse rod and the longitudinal tube.

In order to achieve one or part or all of the aims or other aims, the present disclosure provides the bushing for connecting the longitudinal tube and the transverse rod of the bed frame as follows.

The bushing includes an inner hole, outer wall surfaces, and plug-in portion edges. The inner hole is configured to cover an end portion of the transverse rod. The outer wall surfaces are configured to accommodate in a slot of the longitudinal tube. The plug-in portion edges are configured to abut against an outer wall of a first slot opening of the slot of the longitudinal tube facing the transverse rod for enabling the transverse rod to be fixed perpendicularly to the longitudinal tube.

Furthermore, a limiting eave portion is disposed on an upper wall of a plug-in portion of the bushing and extends along an upper tube wall surface of an upper tube wall of the longitudinal tube, the limiting eave portion is configured to abut against the upper tube wall surface of the upper tube wall of the longitudinal tube, so as to limit a height difference between an upper surface of the transverse rod and the upper tube wall surface of the upper tube wall of the longitudinal tube.

Furthermore, at least one locking oblique protrusion is disposed on a first outer wall surface of the bushing away from the plug-in portion of the bushing, an upper plane of the at least one locking oblique protrusion is parallel to a lower plane of the limiting eave portion, a gap between the at least one locking oblique protrusion and the limiting eave portion is configured to accommodate the upper tube wall of the longitudinal tube.

Furthermore, a distance between an oblique surface of the at least one locking oblique protrusion and the first outer wall surface of the bushing is gradually decreased from top to bottom, so that the end portion of the transverse rod is placed into the slot of the longitudinal tube from a second slot opening of the slot of the longitudinal tube facing upward.

Furthermore, locking slots are respectively defined on two second outer wall surfaces of the bushing, the two second outer wall surfaces of the bushing are respectively disposed at a left side of the plug-in portion of the bushing and a right side of the plug-in portion of the bushing, extending directions of the locking slots are perpendicular to the upper wall of the plug-in portion of the bushing, and the locking slots are respectively attached to the plug-in portion edges. The locking slots are configured to accommodate a left slot edge and a right slot edge of the first slot opening of the slot of the longitudinal tube facing the transverse rod, so that the bushing is prevented to loosening from the first slot opening of the slot of the longitudinal tube facing the transverse rod.

Furthermore, the inner hole of the bushing is a blind hole.

Furthermore, a cross section of the inner hole of the bushing is square.

Furthermore, the bushing is made of a nylon material and a glass fiber material.

Furthermore, a width of the cross section of the inner hole of the bushing is 10.2 mm, a height of the cross section of the inner hole of the bushing is 20.2 mm; and a width of a cross section of the transverse rod is the 10 mm, a height of the cross section of the transverse rod is 20 mm.

The present disclosure further provides the bed frame, including two longitudinal tubes, transverse rods, and bushings. The transverse rods are disposed between the two longitudinal tubes at intervals. The bushings are configured to connect the two longitudinal tubes and the transverse rods, and each of the bushings is the bushing as foregoing. Slots are respectively defined on the two longitudinal tubes corresponding to the transverse rods, end portions of the transverse rods are respectively accommodated into the slots after the bushings respectively cover the end portions of the transverse rods.

Beneficial effects of embodiments of the present disclosure are as follows.

According to the embodiments of the present disclosure, the bushing covers the end portion of the transverse rod for accommodating the end portion of the transverse rod into the slot of the longitudinal tube, since the bushing separates the end portion of the transverse rod and the longitudinal tube, the transverse rod and the longitudinal tube are avoided from rigid surface contact, thereby avoiding from generating friction and friction sound therebetween, in this way, the friction and the friction sound between the transverse rod and the longitudinal tube are effectively reduced, damage caused by the rigid surface contact of the transverse rod and the longitudinal tube is further reduced, a good buffering effect is achieved, and service life of the transverse rod and the longitudinal tube is further prolonged. Moreover, the transverse rod and the longitudinal tube are not prone to abrasion and deformation after the transverse rod and the longitudinal tube are repeatedly disassembled and assembled since the bushing connects the transverse rod and the longitudinal tube and separates the transverse rod and the longitudinal tube.

BRIEF DESCRIPTION OF DRAWINGS

In order to more clearly illustrate embodiments of the present disclosure or technical solutions in the prior art, drawings required in description of the embodiments or the prior art are briefly described below, and obviously, the drawings in following description are merely some embodiments of the present disclosure, and for those who skilled in the art, other drawings may be obtained according to these drawings without creative efforts.

Figure 1:
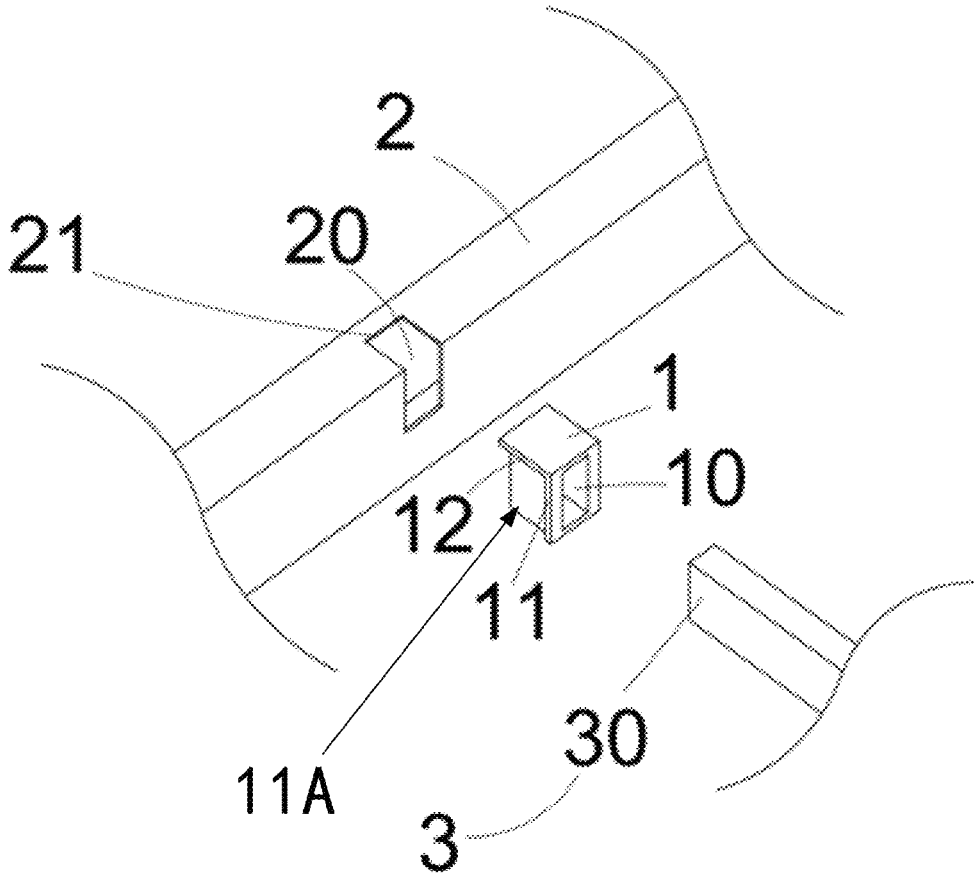
FIG. 1 is a partial schematic diagram of a bushing, a transverse rod, a longitudinal tube according to one embodiment of the present disclosure.
Figure 2:
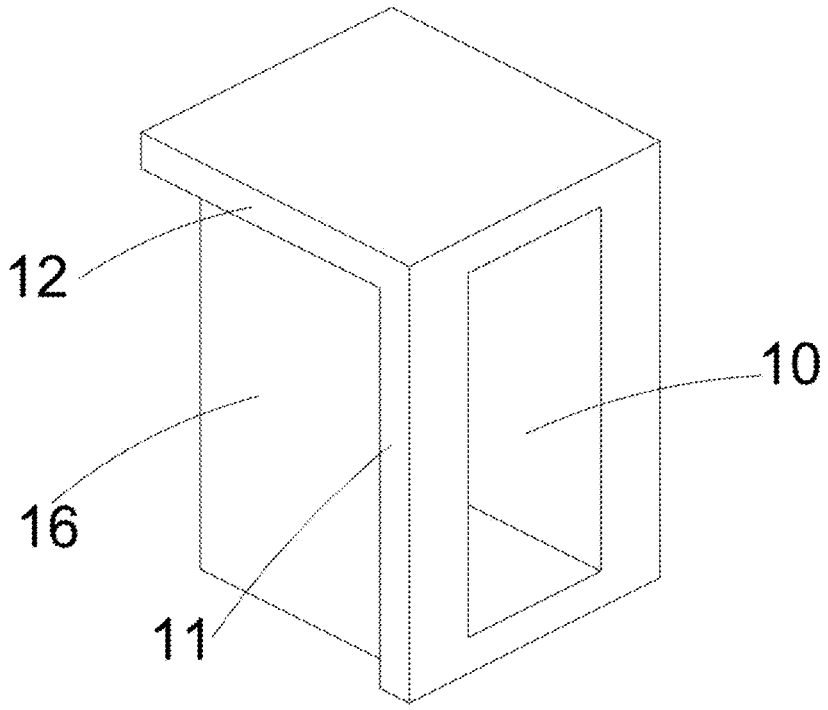
FIG. 2 is a first structural schematic diagram of the bushing according to one embodiment of the present disclosure.

Reference numerals in the drawings: 1. bushing; 10. inner hole; 11. plug-in portion edge; 11A, plug-in portion; 12. limiting eave portion; 13. at least one locking oblique protrusion; 14. locking slot; 15. first outer wall surface; 16. second outer wall surface; 2. longitudinal tube; 20. slot; 21. upper tube wall surface; 3. transverse rod; 30. end portion; 4. bed head board; 5. bed end board.

DETAILED DESCRIPTION OF EMBODIMENTS

Unless otherwise defined, all technical and scientific terms used herein have the same meaning as commonly understood by those who skilled in the art to which the present disclosure belongs; terms used in the specification of the present disclosure herein are for a purpose of describing specific embodiments only and are not intended to limit the present disclosure; terms "include" and "have" and any deformation thereof in the specification, claims, and drawings of the present disclosure are intended to cover non-exclusive inclusion. In the specification, claims, or accompanying drawings of the present disclosure, terms "first", "second", etc. are used to distinguish different objects, rather than to describe a specific order.

Reference herein to "embodiment" means that a particular feature, structure, or characteristic described in combination with embodiments may be included in at least one embodiment of the present disclosure. The appearances of the phrases in various places in the specification are not necessarily all referring to the same embodiment, nor are separate or alternative embodiments mutually exclusive with other embodiments. It is explicitly and implicitly understood by those who skilled in the art that the embodiments described herein may be combined with other embodiments.

In order to enable those who skilled in the art to better understand solutions of the present disclosure, technical solutions in the embodiments of the present disclosure are clearly and completely described below with reference to the accompanying drawings.

Please refer to FIGS. 1-6, the embodiments of the present disclosure provide a bushing 1 for connecting a longitudinal tube 2 and a transverse rod 3 of a bed frame. The bushing 1 includes an inner hole 10, outer wall surfaces, and plug-in portion edges 11. The inner hole 10 is configured to cover an end portion 30 of the transverse rod 3. The outer wall surfaces are configured to accommodate in a slot 20 of the longitudinal tube 2. The plug-in portion edges 11 are configured to abut against an outer wall of a first slot opening of the slot 20 of the longitudinal tube 2 facing the transverse rod 3 for enabling the transverse rod 3 to be fixed perpendicularly to the longitudinal tube 2.

Specifically, the bushing 1 is mainly configured to connect the transverse rod 3 and the longitudinal tube 2 made of metal materials to avoid direct contact between the transverse rod 3 and the longitudinal tube 2, thereby reducing damage caused by rigid surface contact of the transverse rod 3 and the longitudinal tube 2.

In the embodiment, the longitudinal tube 2 is a square tube, and the slot 20 is a slot structure going across adjacent tube walls of the longitudinal tube 2. The longitudinal tube 2 is a square rod, a shape of a cross section of the inner hole 10 corresponds to a shape of the transverse rod 3. In the embodiment, the cross section of the inner hole 10 of the bushing 1 is square; a width of the inner hole 10 of the bushing 1 is 10.2 mm, a height of the inner hole 10 of the bushing 1 is 20.2 mm; and a width of a cross section of the transverse rod 3 is the 10 mm, a height of the cross section of the transverse rod 3 is 20 mm, a smaller gap between the bushing 1 and the transverse rod 3 enables the bushing 1 to better cover the end portion 30 of the transverse rod 3, so that the end portion 30 of the transverse rod 3 is prevented from easily loosening from the bushing 1.

In the embodiment, the inner hole 10 of the bushing 1 is a blind hole for transversely limiting the end portion 30 of the transverse rod 3, edges of the inner hole 10 are chamfered, and the bushing 1 is sleeved on the end portion 30 of the transverse rod 3.

In the embodiment, a depth of the inner hole 10 of the bushing 1 is greater than or equal to a transverse depth of the slot 20, so that after the bushing 1 covering the end portion 30 of the transverse rod 3 is connected to the slot 20, the transverse rod 3 is not in direct contact with the longitudinal tube 2. Since the bushing 1 separates the end portion 30 of the transverse rod 3 and the longitudinal tube 2, the transverse rod 3 and the longitudinal tube 2 are avoided from the rigid surface contact, thereby avoiding from generating friction and friction sound therebetween, in this way, the friction and the friction sound between the transverse rod 3 and the longitudinal tube 2 are effectively reduced, damage caused by the rigid surface contact of the transverse rod 3 and the longitudinal tube 2 is further reduced, a good buffering effect is achieved, and service life of the transverse rod 3 and the longitudinal tube 3 is further prolonged. Moreover, the transverse rod 3 and the longitudinal tube 2 are not prone to abrasion and deformation after the transverse rod 3 and the longitudinal tube 2 are repeatedly disassembled and assembled since the bushing 1 connects the transverse rod 3 and the longitudinal tube 2 and separates the transverse rod 3 and the longitudinal tube 2.

In a current bed frame structure, a distance between two longitudinal tubes and a length of each of transverse rods are fixed, and since the longitudinal tubes are hollow tubular structures, slots of the longitudinal tubes do not have corresponding slot walls, in the embodiment, in order to avoid the transverse rod 3 from inserting into the longitudinal tube 2 along the slot 20 to cause that an end of the transverse rod 3 opposite to the end portion 30 of the transverse rod 3 cannot be normally connected into a corresponding slot of another longitudinal tube 2 when assembling the bed frame, the plug-in portion edges 11 are disposed at a plug-in portion 11A of the bushing 1, when the bushing 1 is accommodated in the slot 20, the plug-in portion edges 11 abut against the outer wall of the first slot opening of the slot 20 of the longitudinal tube 2 facing the transverse rod 3 for enabling the transverse rod 3 to be fixed perpendicularly to the longitudinal tube 2. In this way, the transverse rod 3 cannot continue to go deep along the transverse depth of the slot 20, so that each end portion of the transverse rod 3 is connected to a corresponding longitudinal tube 2.

In order to further improve connection stability between the bushing 1 and the slot 20 of the longitudinal tube 2 and avoid the end portion 30 of the transverse rod 3 from going deeper into the longitudinal tube 2 along a vertical direction of the slot 20 after assembling, in the embodiment, a limiting eave portion 12 is disposed on an upper wall of the plug-in portion 11A of the bushing 1 and extends along an upper tube wall surface of an upper tube wall 21 of the longitudinal tube 2, the limiting eave portion 12 is configured to abut against the upper tube wall surface of the upper tube wall 21 of the longitudinal tube 2, so as to limit a height difference between an upper surface of the transverse rod 3 and the upper tube wall surface of the upper tube wall 21 of the longitudinal tube 2. Specifically, the limiting eave portion 12 is a three-edge extension structure of the upper wall of the plug-in portion 11A of the bushing 1. When the bushing 1 is accommodated in the slot 20 of the longitudinal tube 2, a lower plane of the limiting eave portion 12 is attached to the upper tube wall surface of the upper tube wall 21 of the longitudinal tube 2, thereby inserting the end portion 30 of the transverse rod 3 downward into the longitudinal tube 2, and it is assumed that two longitudinal tubes 2 are provided, when the transverse rod 3 are disposed on the two longitudinal tubes 2, a height difference between the upper surface of the transverse rod 3 and an upper tube wall surface of an upper tube wall 21 of each of the two longitudinal tube 2 is unchanged, so as to stably support bed boards of the bed frame.

Furthermore, at least one locking oblique protrusion 13 is disposed on a first outer wall surface 15 of the bushing 1 away from the plug-in portion 11A of the bushing 1, an upper plane of the at least one locking oblique protrusion 13 is parallel to the lower plane of the limiting eave portion 12, a gap between the at least one locking oblique protrusion 13 and the limiting eave portion 12 is configured to accommodate the upper tube wall 21 of the longitudinal tube 2. After the bushing 1 is accommodated in the slot 20, the upper tube wall 21 of the longitudinal tube 2 is disposed in the gap between the at least one locking oblique protrusion 13 and the limiting eave portion 12, that is, the at least one locking oblique protrusion 13 and the limiting eave portion 12 cooperatively clamp the upper tube wall 21 of the longitudinal tube 2, thereby avoiding the bushing 1 from moving upward to separate from the slot 20, and improving connection stability between the transverse rod 3 and the longitudinal tube 2. One or more locking oblique protrusions 13 are provided according to an actual size of the bushing 1. In order to ensure that the upper tube wall 21 of the longitudinal tube 2 is capable of being disposed in the gap between the at least one locking oblique protrusion 13 and the limiting eave portion 12 after the bushing 1 is inserted into the slot 20, in the embodiment, a distance between the lower plane of the limiting eave portion 12 and a bottom outer wall surface of the plug-in portion 11A of the bushing 1 is equal to a vertical depth of the slot 20 of the longitudinal tube 2, that is, when the at least one locking oblique protrusion 13 and the limiting eave portion 12 cooperatively clamp the upper tube wall 21 of the longitudinal tube 2, the bottom outer wall surface of the plug-in portion 11A of the bushing 1 abuts against a lower slot edge of the first slot opening of the slot 20 of the longitudinal tube 2, so as to improve connection stability between the bushing 1 and the longitudinal tube 2.

Figure 3:
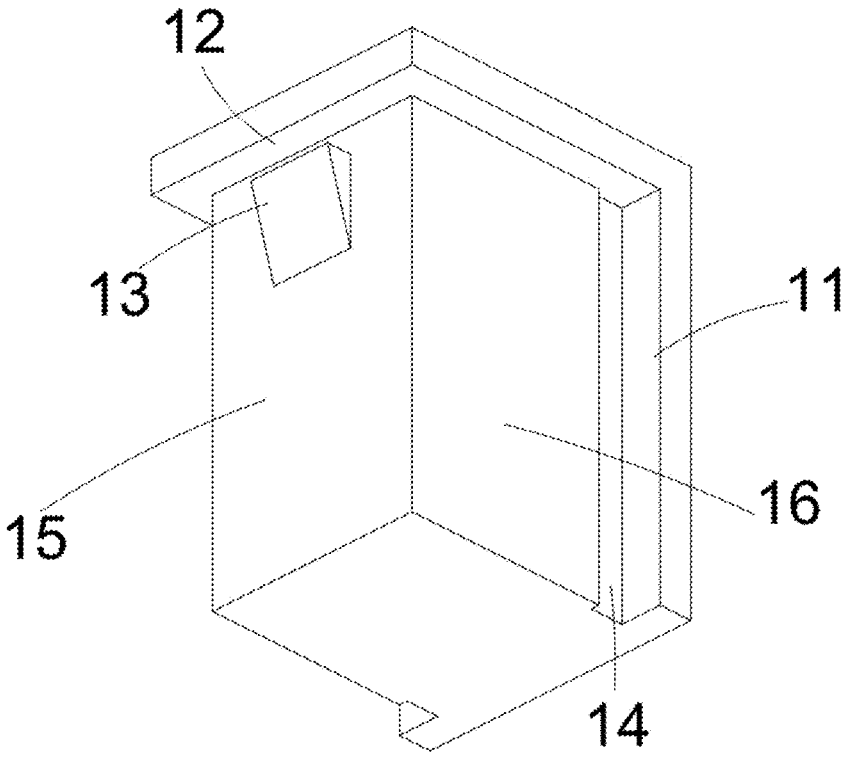
FIG. 3 is a second structural schematic diagram of the bushing according to one embodiment of the present disclosure.
Figure 4:
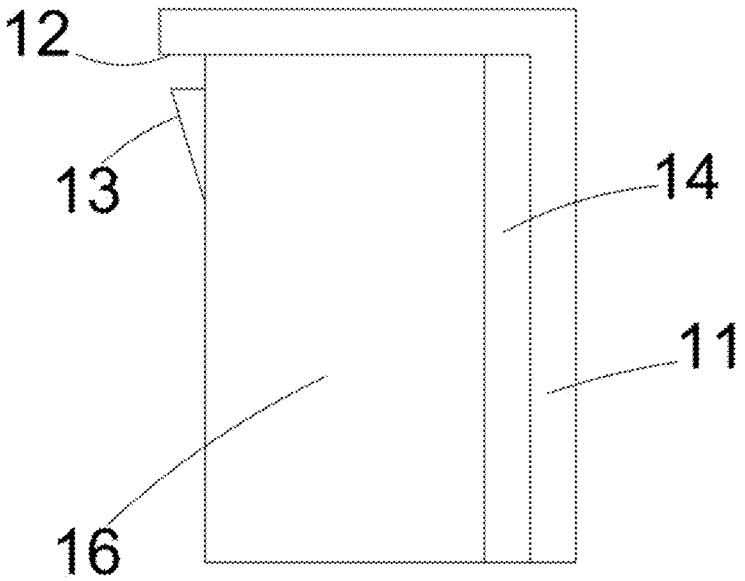
FIG. 4 is a side schematic diagram of the bushing according to one embodiment of the present disclosure.
Figure 5:
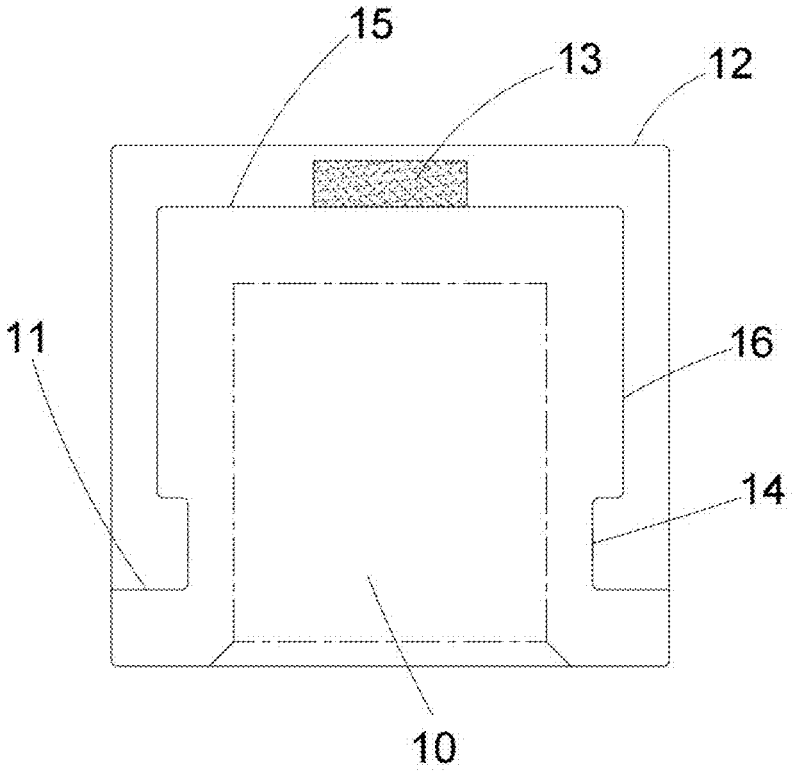
FIG. 5 is a bottom schematic diagram of the bushing according to one embodiment of the present disclosure.
Figure 6:
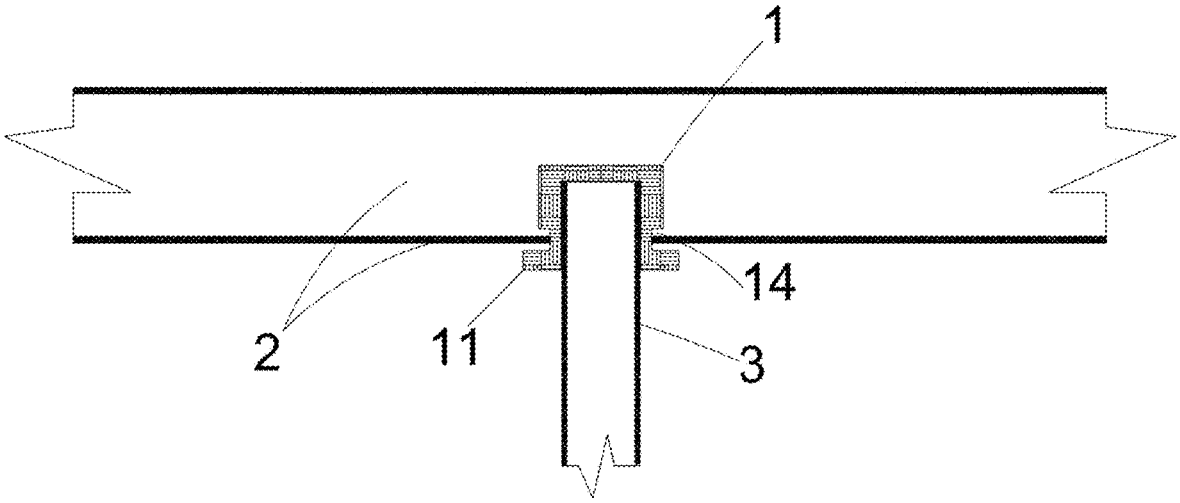
FIG. 6 is a partial cross-sectional schematic diagram of the bushing, the transverse rod, and the longitudinal tube according to one embodiment of the present disclosure.

Please refer to FIGS. 3-4, in order to quickly clamp the upper tube wall 21 of the longitudinal tube 2 by the at least one locking oblique protrusion 13 and the limiting eave portion 12 for quickly accommodating the bushing 1 when inserting the bushing 1 into the slot 20 of the longitudinal tube 2 from top to bottom, a distance between an oblique surface of the at least one locking oblique protrusion 13 and the first outer wall surface 15 of the bushing 1 is gradually decreased from the top to the bottom, when the bushing 1 is inserted into the slot 20 from the top to the bottom, the oblique surface of the at least one locking oblique protrusion 13 is first in contact with an upper slot edge of a second slot opening of the slot 20, and then the bushing 1 is pressed downward with force, so that the at least one locking oblique protrusion 13 and the limiting eave portion 12 are capable of cooperatively clamping the upper tube wall 21 of the longitudinal tube 2, in this way, the end portion 30 of the transverse rod 3 is placed into the slot 20 of the longitudinal tube 2 from the second slot opening of the slot 20 of the longitudinal tube 2, the second slot opening of the slot 20 of the longitudinal tube 2 faces upward.

Please refer to FIGS. 3-4, since the longitudinal tube 2 is made of the metal materials, after defining the slot 20 across the adjacent tube walls of the longitudinal tube 2, a left slot edge and a right slot edge of the first slot opening of the slot 20 of the longitudinal tube 2 facing the transverse rod 3 may get closer to each other, in the embodiment, locking slots 14 are respectively defined on two second outer wall surfaces 16 of the bushing 1, the two second outer wall surfaces 16 of the bushing 1 are respectively disposed at a left side of the plug-in portion 11A of the bushing 1 and a right side of the plug-in portion 11A of the bushing 1, extending directions of the locking slots 14 are perpendicular to the upper wall of the plug-in portion 11A of the bushing 1, and the locking slots 14 are respectively attached to the plug-in portion edges 11. The locking slots 14 are configured to accommodate the left slot edge and the right slot edge of the first slot opening of the slot 20 of the longitudinal tube 2 facing the transverse rod 3, so that the bushing 1 is prevented to loosening from the first slot opening of the slot 20 of the longitudinal tube 2 facing the transverse rod 3, in this way, the connection stability between the bushing 1 and the longitudinal tube 2 is further improved.

In the embodiment, the bushing 1 is made of a nylon material and a glass fiber material, specifically, the bushing 1 is prepared by mixing 80% of the nylon material and 20% of the glass fiber material, so as to improve stability, heat resistance, and aging resistance of the bushing 1, and the glass fiber material is capable of further reducing a shrinkage rate of the bushing 1 and improving rigidity and impact resistance of the bushing 1. Since the bushing 1 is made of the nylon material and the glass fiber material, a rigid connection between the longitudinal tube 2 and the transverse rod 3 of the bed frame is converted into a non-rigid connection, so that the longitudinal tube 2 and the transverse rod 3 made of the metal materials are not prone to being damaged, and the service life thereof is prolonged. Moreover, the bushing 1 formed by mixing the nylon material and the glass fiber material effectively reduces noise generated by a connection between the longitudinal pipe 2 and the transverse rod 3, so that when users roll on the bed frame using the bushing 1 for connection, the bed frame does not generate noise, and sleep experience of the users is effectively improved.

Figure 7:
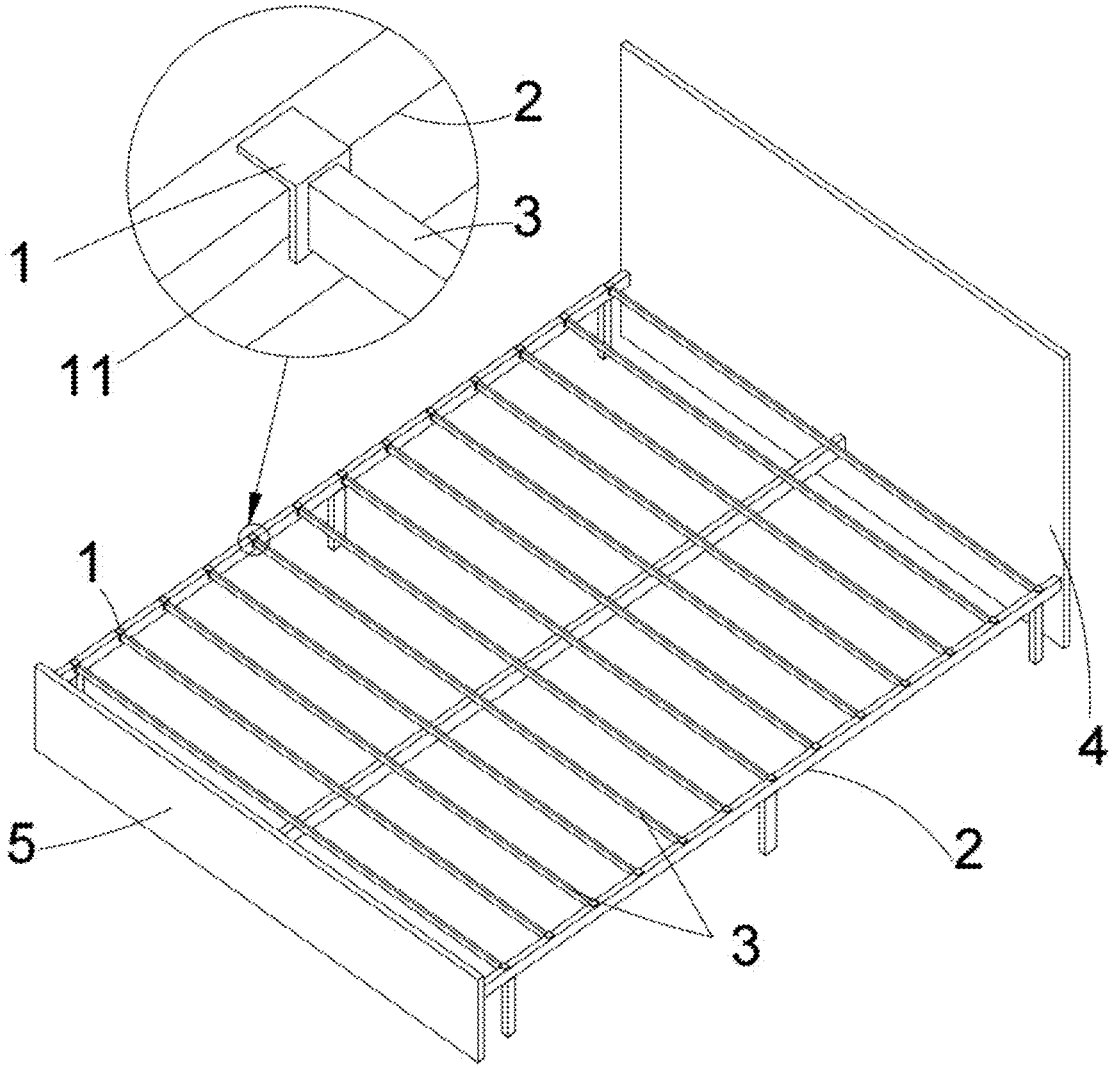
FIG. 7 is a structural schematic diagram of a bed frame according to one embodiment of the present disclosure.

Please refer to FIG. 7, the embodiments of the present disclosure further provide the bed frame, including two longitudinal tubes 2 and transverse rods 3. The transverse rods 3 are disposed between the two longitudinal tubes 2 at intervals. The bed frame further includes bushings, a bed head board 4, and a bed end board 5. The bed head board 4 and the bed end board 5 are configured to connect ends of the two longitudinal tubes 2. Each of the bushings 1 is the bushing as foregoing. Slots 20 are respectively defined on the two longitudinal tubes 2 corresponding to the transverse rods 3, end portions 30 of the transverse rods 3 are respectively accommodated into the slots 20 after the bushings 1 respectively cover the end portions 30 of the transverse rods 3.

Obviously, the embodiments described above are only a part but not all of the embodiments of the present disclosure, and the accompanying drawings illustrate preferred embodiments of the present disclosure, but do not limit a patent scope of the present disclosure. The present disclosure may be implemented in many different forms, and on the contrary, a purpose of providing these embodiments is to make the understanding of the present disclosure more thorough and comprehensive. Although the present disclosure is described in detail with reference to the foregoing embodiments, for those who skilled in the art, the technical solutions described in the foregoing embodiments may still be modified, or some of the technical features may be equivalently replaced. Any equivalent structure made by using the description and the drawings of the present disclosure and being directly or indirectly used in other related technical fields should all fall within the patent scope of the present disclosure.

What is claimed is:

1. A bushing, for connecting a longitudinal tube and a transverse rod of a bed frame, comprising:

an inner hole, configured to cover an end portion of the transverse rod;

outer wall surfaces, configured to accommodate in a slot of the longitudinal tube; and plug-in portion edges, configured to abut against an outer wall of a first slot opening of the slot of the longitudinal tube facing the transverse rod for enabling the transverse rod to be fixed perpendicularly to the longitudinal tube;

wherein the bushing has an upper wall of a plug-in portion, the upper wall is arranged with a limiting eave portion extending outwardly from the upper wall, the limiting eave portion is configured to abut against an upper tube wall surface of an upper tube wall of the longitudinal tube;

the bushing further has a bottom wall of the plug-in portion, the bottom wall is disposed directly facing towards the upper wall;

an inner surface of the bottom wall contributes to form a hole wall of the inner hole, and an orthographic projection of the upper wall along a first direction on the bottom wall is at least partially overlapped with the inner surface of the bottom wall, wherein the first direction is perpendicular to both a length direction of the longitudinal tube and a direction in which the transverse rod is inserted into the inner hole through the plug-in portion.

2. The bushing according to claim 1, wherein the limiting eave portion is configured to limit a height difference between an upper surface of the transverse rod and the upper tube wall surface of the upper tube wall of the longitudinal tube.

3. The bushing according to claim 2, wherein at least one locking oblique protrusion is disposed on a first outer wall surface of the bushing away from the plug-in portion of the bushing, an upper plane of the at least one locking oblique protrusion directly faces and is parallel to a lower plane of the limiting eave portion, a gap between the at least one locking oblique protrusion and the limiting eave portion is configured to accommodate the upper tube wall of the longitudinal tube.

4. The bushing according to claim 3, wherein a distance between an oblique surface of the at least one locking oblique protrusion and the first outer wall surface of the bushing is gradually decreased from top to bottom, so that the end portion of the transverse rod is placed into the slot of the longitudinal tube from a second slot opening of the slot of the longitudinal tube facing upward.

5. The bushing according to claim 4, wherein locking slots are respectively defined on two second outer wall surfaces of the bushing, the two second outer wall surfaces of the bushing are respectively disposed at a left side of the plug-in portion of the bushing and a right side of the plug-in portion of the bushing, extending directions of the locking slots are perpendicular to the upper wall of the plug-in portion of the bushing, and the locking slots are respectively attached to the plug-in portion edges; the locking slots are configured to accommodate a left slot edge and a right slot edge of the first slot opening of the slot of the longitudinal tube facing the transverse rod, so that the bushing is prevented to loosening from the first slot opening of the slot of the longitudinal tube facing the transverse rod.

6. The bushing according to claim 5, wherein the inner hole of the bushing is a blind hole.

7. The bushing according to claim 5, wherein a cross section of the inner hole of the bushing is square.

8. The bushing according to claim 5, wherein the bushing is made of a nylon material and a glass fiber material.

9. The bushing according to claim 8, wherein a width of the cross section of the inner hole of the bushing is 10.2 mm, a height of the cross section of the inner hole of the bushing is 20.2 mm; and a width of a cross section of the transverse rod is the 10 mm, a height of the cross section of the transverse rod is 20 mm.

10. A bed frame, comprising:

two longitudinal tubes;

transverse rods, disposed between the two longitudinal tubes; and bushings, configured to connect the two longitudinal tubes and the transverse rods;

wherein slots are respectively defined on the two longitudinal tubes corresponding to the transverse rods, end portions of the transverse rods are respectively accommodated into the slots after the bushings respectively cover the end portions of the transverse rods;

each of the bushings comprises:

an inner hole, configured to cover a corresponding one of the end portions of the transverse rods;

outer wall surfaces, configured to respectively accommodate in the slots; and plug-in portion edges, configured to abut against an outer wall of a first slot opening of a corresponding one of the slots facing the transverse rods for enabling the a corresponding one of the transverse rods to be fixed perpendicularly to a corresponding one of the longitudinal tubes;

wherein each of the bushings has an upper wall of a plug-in portion, the upper wall is arranged with a limiting eave portion extending outwardly from the upper wall, the limiting eave portion is configured to abut against an upper tube wall surface of an upper tube wall of a respective one of the two longitudinal tubes;

each of the bushings further has a bottom wall of the plug-in portion, the bottom wall is disposed directly facing towards the upper wall;

an inner surface of the bottom wall contributes to form a hole wall of the inner hole, and an orthographic projection of the upper wall along a first direction on the bottom wall is at least partially overlapped with the inner surface of the bottom wall; wherein the first direction is perpendicular to both a length direction of the longitudinal tube and a direction in which the transverse rod is inserted into the inner hole through the plug-in portion.

* * * * *